US005823036A

United States Patent [19]

Matsunaga

[11] Patent Number: 5,823,036

[45] Date of Patent: Oct. 20, 1998

[54] ROLL FORMING MACHINE AND METHOD FOR CHANGING ROLLS

[75] Inventor: Douglas S. Matsunaga, Mettawa, Ill.

[73] Assignee: Braner USA, Inc., Schiller Park, Ill.

[21] Appl. No.: 914,193

[22] Filed: Aug. 19, 1997

[51] Int. Cl.[6] ..... B21B 31/10

[52] U.S. Cl. ..... 72/181; 72/226; 72/239

[58] Field of Search ..... 72/181, 238, 239, 72/226

[56] References Cited

U.S. PATENT DOCUMENTS

| | | | |
|---|---|---|---|
| 3,979,939 | 9/1976 | Pazderka | 72/329 |
| 4,005,594 | 2/1977 | Reth | 27/239 |

FOREIGN PATENT DOCUMENTS

| | | | |
|---|---|---|---|
| 851941 | 10/1952 | Germany | 72/239 |
| 317608 | 12/1989 | Japan | 72/239 |
| 392997 | 8/1973 | U.S.S.R. | 72/238 |

*Primary Examiner*—Daniel C. Crane
*Attorney, Agent, or Firm*—Baker & Daniels

[57] ABSTRACT

A roll forming machine or tube mill comprises multiple mill stands defining a material pass line through the mill stands. The mill stands include rotating arbors carrying tooling which are supported between a drive bearing housing and a rotatable bearing housing. Inactive rollers extend outwardly from the rotatable bearing housing, such that upon rotation of the rotatable bearing housing the inactive arbors can moved to the active position and the formerly active arbors can be moved to an inactive or retooling position on the outside of the mill stands. A change cart includes rails on the upper surface thereof that are brought into registry with corresponding rails on the housing support upon which the rotatable bearing housing is mounted. The rotatable bearing housing is then slid off onto the cart, rotated, and then moved back onto the bearing housing support. The cart then can be disengaged and moved along rails supporting the cart to a position adjacent a succeeding mill, to enable changeover of the succeeding mill.

12 Claims, 5 Drawing Sheets

ROLL FORMING MACHINE AND METHOD FOR CHANGING ROLLS

This invention relates to a roll forming machine for forming flat sheet stock into welded tubing.

Roll forming machines, also known as tube mills, include multiple mill stands each having rolls of slightly different design that are used for progressively forming flat sheet stock into a tube. However, different forming rolls must be used for each type and size of tube. Accordingly, it is often necessary to shut down the line and retool the tube mills. Several hours are often required to retool the tube mill. U.S. Pat. No. 5,450,740 discloses a tube mill in which the time required to retool the line is substantially reduced because the support frame which supports the rotatable arbors upon which the rolls are mounted, also support inactive arbors coaxially with the active arbors. Accordingly, the inactive arbors may be retooled while the tube mill is operating. The support frame can then be shifted out of the pass line, the upright rotated about a turret so that the inactive arbors become the active arbors, and the upright shifted back into position so that the arbors may be connected to the drive stand. By shifting the upright out of the pass line, the upright may be rotated without interference of the arbors with the other mill stands in the line.

The present invention makes it even easier and quicker to change tooling on tube mills. The bearing support on which arbors are mounted is slidably mounted on a housing support via rails to permit slidable movement of the bearing support relative to the bearing housing support. A cart is mounted on rails which extend adjacent the mill stand substantially parallel to the material pass line. The cart support rails which extend transversely to the material pass line such that the cart can be moved into a position in which the transversely extending rails of the cart register with corresponding rails on the bearing housing support. The cart is then locked to the bearing housing support with the rails on the bearing housing support registered with the rail on the cart, the rotatable bearing support is then shifted out of the material pass line and rotated about its turret to bring the new tools or rolls into position, and the bearing support is then shifted back into the operative position in the material pass line. The cart can then be disconnected from the bearing housing support of one mill stand and moved to another mill stand where the changing process is repeated. The inactive tooling can be inspected and changed by someone standing on the floor instead of requiring the operator to climb over the mill base.

This and other advantages of the present invention will become apparent from the following description, with reference to the accompanying drawings, in which.

Figure 1:
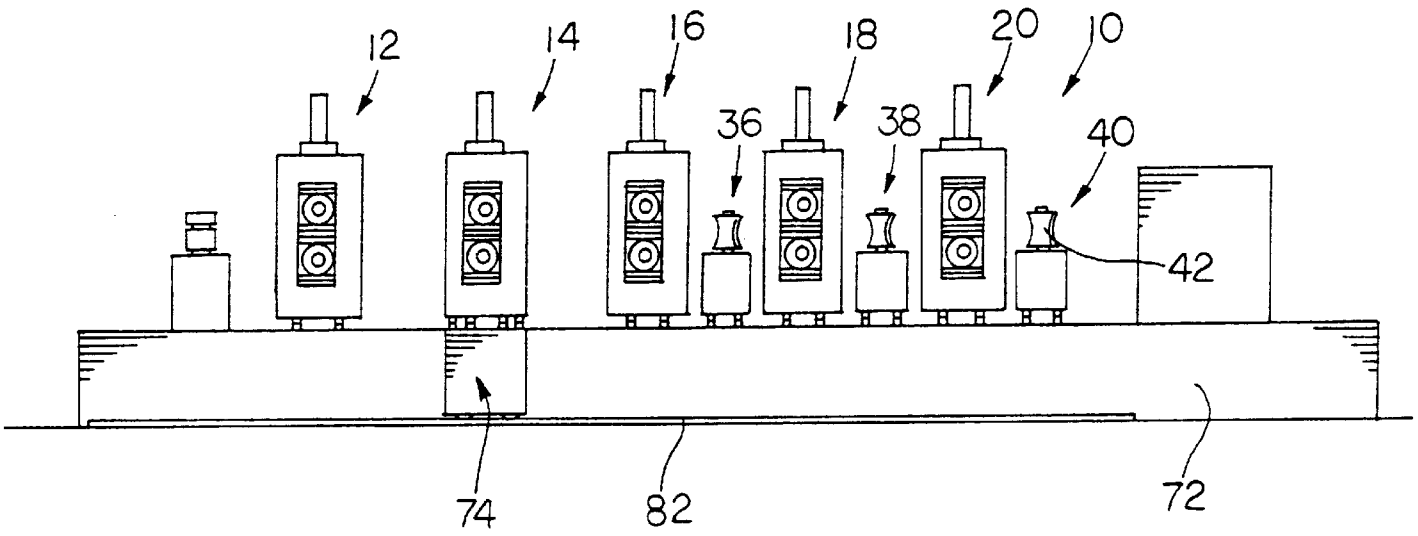
FIG. 1 is a side elevational view of a portion of a roll forming machine made pursuant to the teachings of the present invention.
Figure 6:
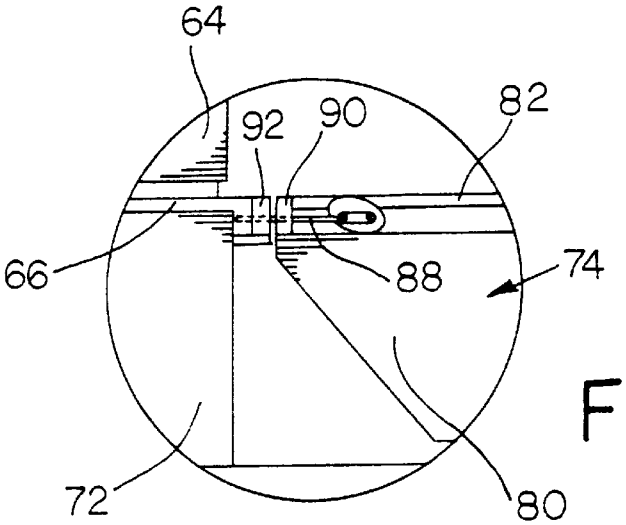
FIG. 6 is an enlargement of the circumscribed portion of FIG. 3.
Figure 2:
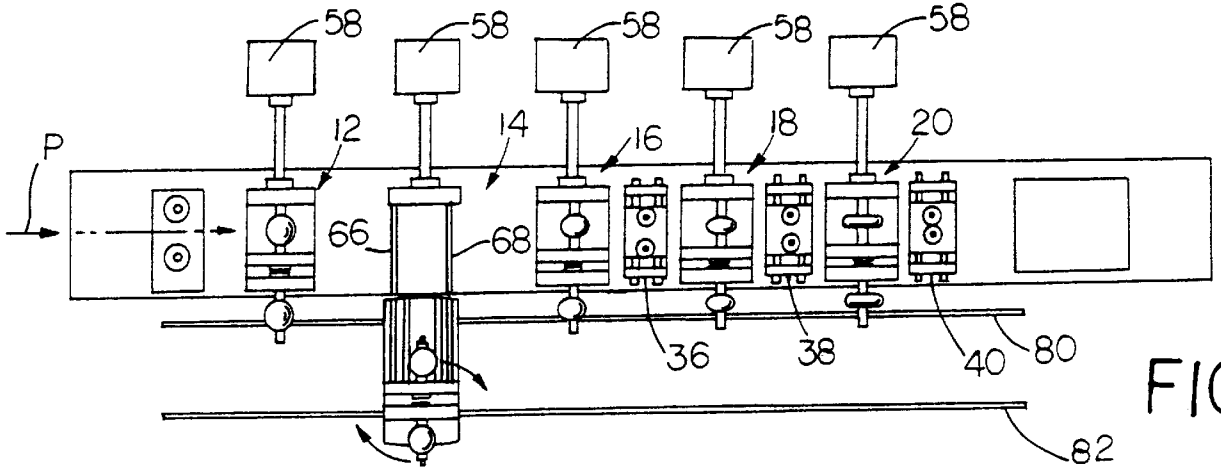
FIG. 2 is a top plan view of the roll forming machine illustrated in FIG. 1.
Figure 4:
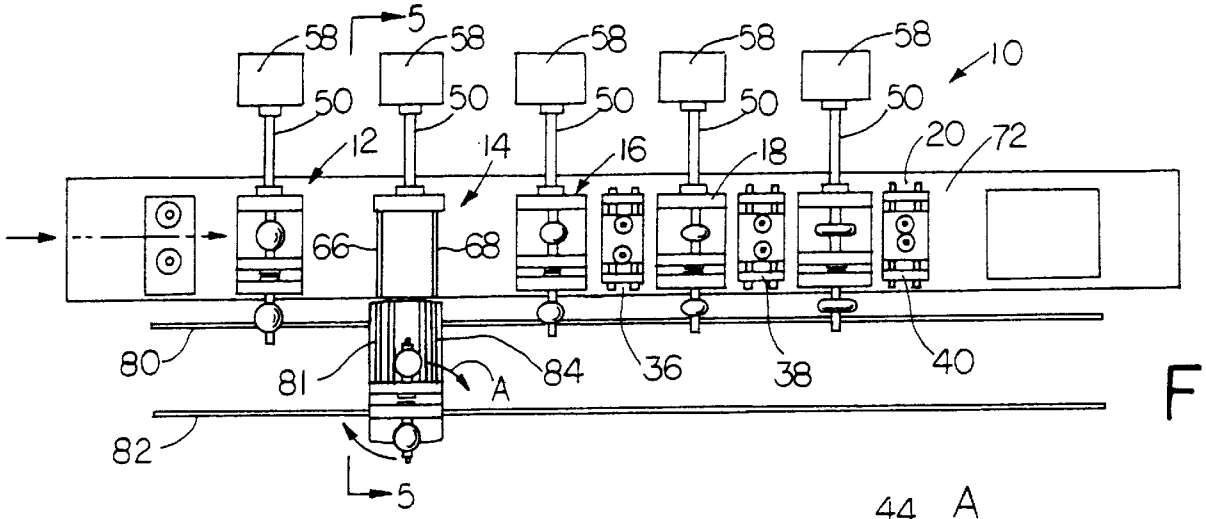
FIG. 4 is a view similar to FIG. 2, but illustrating one of the bearing supports displaced from the material pass line of the roll forming machine to illustrate the manner in which the arbors are switched during a tool change operation.

Referring now to the drawings, reference numeral 10 generally designates a roll forming machine or tube mill line, which is commonly used in making welded tubes from flat sheet metal stock. As shown in FIGS. 1, 2 and 4, tube mill 10 typically includes mill stands 12, 14, 16, 18 and 20, which carry an active pair of horizontal arbors 22, 24 upon which vertically extending "pinch" rollers 26, 28 and an inactive pair of arbors 30, 32, upon which rollers 33 and 34 are mounted. Tube line 10 further includes mill stands 36, 38 and 40, upon which are mounted side rollers on generally vertically extending arbors. The mill stands 12–20 and 36–40 cooperate to define a material pass line P along which sheet material is fed and formed into a tube. Generally, the process in which welded tubes are made from sheet stock is well known in the art and will not be described in detail herein. It will further be understood that, depending upon the type of strip being processed and the size and design of the tubes being produced, any number of mill stands 12–20 and 36–40 will be used. Generally, the present invention relates to an apparatus and method for changing and retooling the mill stands 12–20 having generally horizontally extending arbors to produce different sizes and designs of tubes from various types of sheet stock. It will be understood that each of the mill stand 12–20 are substantially identical and that the arbors of each will be changed in the same way, so that only the mill stand 14 will be described in detail.

Mill stand 14 includes a drive bearing housing generally indicated by the numeral 42 and a rotatable bearing housing generally indicated by the numeral 44. Rotatable bearing housing 44 includes uprights 46, 48. One end of the arbors 22, 24 are mounted for rotation relative to the drive housing 42, and the opposite ends of the arbor 22, 24 are mounted for rotation in upright 46 of the rotatable bearing housing 44. Drive shafts 50, 52 drivingly connect the arbors 22, 24 via stub shafts 54, 56 to a motor (not shown) located in the housing 58. Accordingly, the arbors 22, 24 are driven by the motor within the housing 58 through the drive shafts 50 and 52 and the stub shafts 54, 56. The active rotors 22 and 24, as well as the inactive arbors 30 and 32, are provided with sliding connectors 60, 62 that are adapted to engage with corresponding connectors in the stub shaft 54, 56 as will hereinafter be described. The inactive rollers 30, 32 are mounted for rotation in upright 48 of the rotary bearing housing 44.

The uprights 46, 48 of rotatable bearing housing 44 are supported by a turret mechanism generally indicated by the numeral 64 that supports the rotatable bearing housing for rotation about a generally vertical axis. Turret mechanism 64 is of the same general type as disclosed in the above identified U.S. Pat. No. 5,450,740, and will not be disclosed in detail herein. The turret mechanism 64 is supported by rollers or glides (not shown) which support the rotatable bearing housing 44 on spaced apart rails 66, 68 mounted on upper surface 70 of a bearing housing support generally indicated by the numeral 72.

As will hereinafter be described, rotation of the rotatable bearing housing 14 in order to bring the forming rolls 33, 34 into the active position is facilitated by a changing cart generally indicated by the numeral 74. Changing cart 74 includes glides or rollers 76, 78 that engage inner and outer longitudinally extending rails 80, 82 that extend parallel to the pass line P of the material through the roll forming machine 10 in close proximity to the rotatable bearing housing 14 of each of the mill stands 12–20. The cart 74 further includes a projecting portion 79 which projects toward the bearing housing support 72 and terminates in close proximity thereto. A pair of rails 83, 84 are mounted on an upper surface 86 of the cart 74 and are substantially the same distance apart as are the rails 66, 68 and extend transversely to the material pass line P, so that the rail 83 may be brought into registry with the rail 66 and the rail 84 may be brought into registry with the rail 68 when the cart 74 is moved into a changing position for the mill stand 14 illustrated in FIG. 2. When this occurs, a locking pin 88 extends through registering apertures in an ear 90 carried by the cart 74 and an ear 92 carried on the bearing housing support 72. Accordingly, when the pin 88 is installed in the registering apertures, the cart 74 is locked against movement relative to the corresponding mill stand, in this case, the mill stand 14. A second set of rails 85, 87 may optionally be provided on cart 74 for changing the side roll stands 36–40, as more completely explained in co-pending U.S. patent application Ser. No. 08/914,741 filed Aug. 19, 1997.

Figure 3:
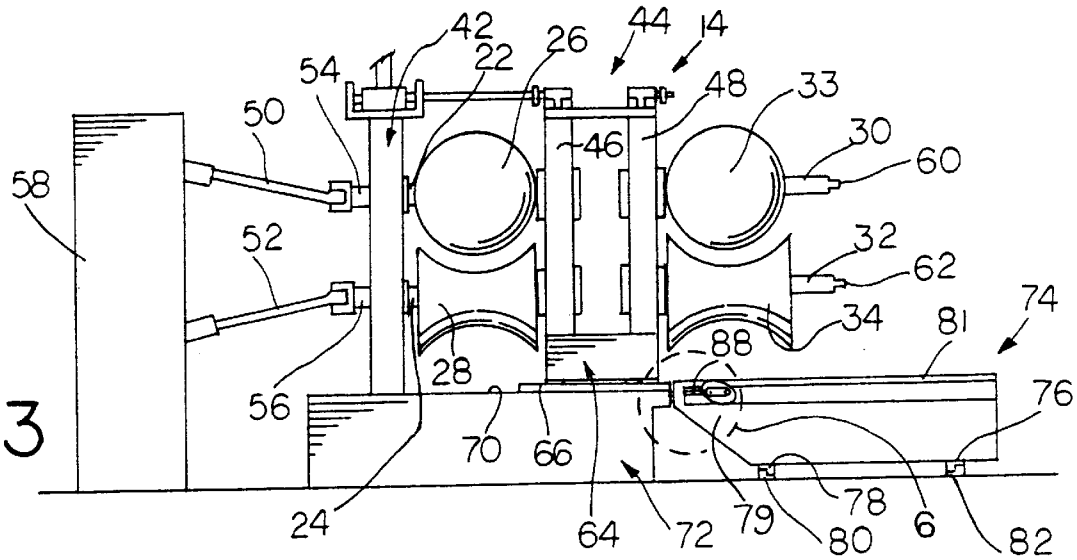
FIG. 3 is a cross sectional view taken substantially along lines 3—3 of FIG. 2.

In operation, it is necessary to change the tooling or rollers 26, 28 whenever tubes of a different style or a different diameter are to be produced. Accordingly, new tooling or rollers, such as the rollers 33, 34, are installed on the inactive arbors 30, 32. When changeover is to be effected, the cart is moved into the position illustrated in FIGS. 2 and 3, and locking pin 88 is engaged with the aperture in ears 90, 92 to thereby lock the cart in position with the rail 82 in registry with the rail 66 and the rail 84 in registry with the rail 68. At this time it is possible to disconnect the arbors 22, 24 from the stub shaft 54, 56, and slide the rotary bearing housing 14 to the right viewing FIG. 3 (or downwardly viewing FIG. 2) so that the rotatable bearing support 44 is disposed on the cart and is therefore displaced off of the material pass line to an extent that rotation may take place without interference of any of the arbors 22, 24 or 30, 32 with one or the other mill stands. Accordingly, the distance between mill stands is not limited to that which would permit rotation of the rotatable bearing support 44. Clearly, it is desirable to have a short a mill line as possible, so that it is desirable to place the mill stands as close together as feasible.

Figure 5:
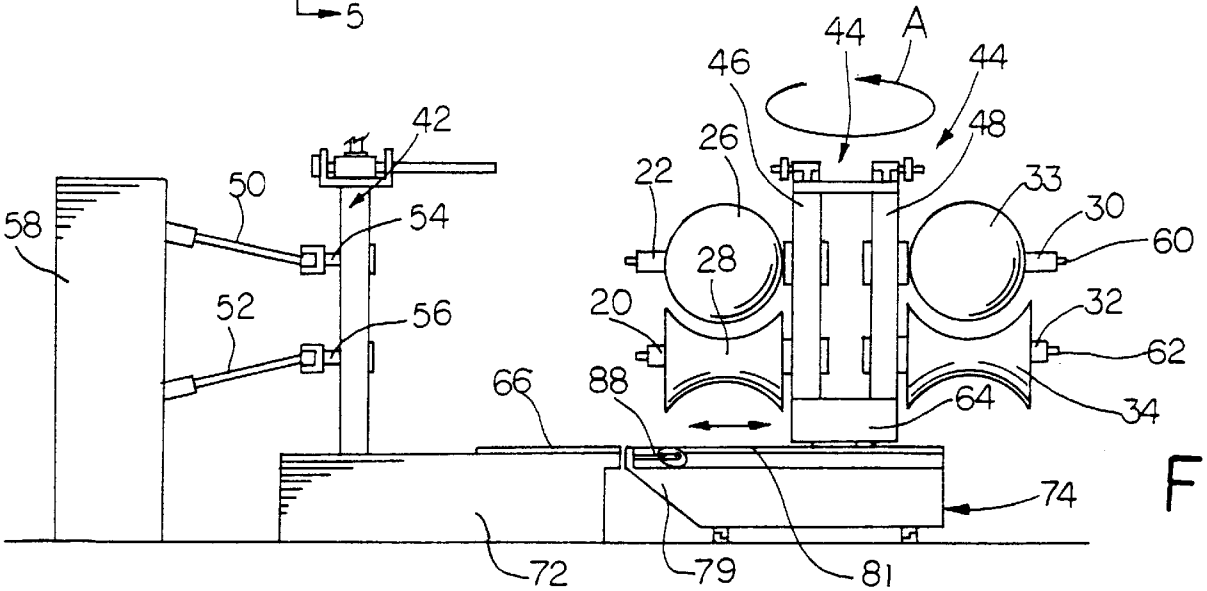
FIG. 5 is a cross sectional view taken substantially along lines 5—5 of FIG. 4.

After the rotary bearing housing 44 has been displaced to the position illustrated in FIGS. 4 and 5, the rotation of the rotatable bearing housing as indicated by the arrows A may take place, thereby bringing the arbors 30 and 32 and their associated tooling or rollers 33, 34 into a position such that the arbors 30, 32 extend toward the drive bearing housing 44. The rotatable bearing support 44 is then shifted back into the position illustrated in FIGS. 2 and 3, and the arbors 30, 32, which are now the active arbors, are engaged with the stub shafts 54, 56 so that production can be resumed. The pin 88 is then disengaged, and the cart 74 is rolled away from the bearing housing 14, permitting the tooling 33, 34 to be inspected, changed or repaired without interference from the cart or the bearing housing support 72. Accordingly, bearing housing support 72 can be made narrower than was possible in the prior art, since it only need be wide enough to support the rotatable bearing housing 44 when it is in the active or production position illustrated in FIGS. 2 and 3. Accordingly, the inactive tooling 33, 34 can be inspected by someone standing on the ground, without having to climb over the bearing housing support 72. Furthermore, equipment and fixtures may be moved into place to facilitate inspection, removal or repair and replacement of the tooling or rollers 33, 34, all without interference with the bearing housing support 72 or the cart 74, which can be rolled out of the way along rails 80, 82. If additional tooling of one of the other mill stands 12–20 is to be changed, the cart 74 is moved into a corresponding position adjacent the other mill stand, the pin 88 engaged with the corresponding bearing housing support, and the rotatable bearing housing 44 of that mill stand is then moved on to the cart 74. This process can be repeated for each of the mill stands 12–20 if all the tooling is to be changed at one time.

Figure 7:
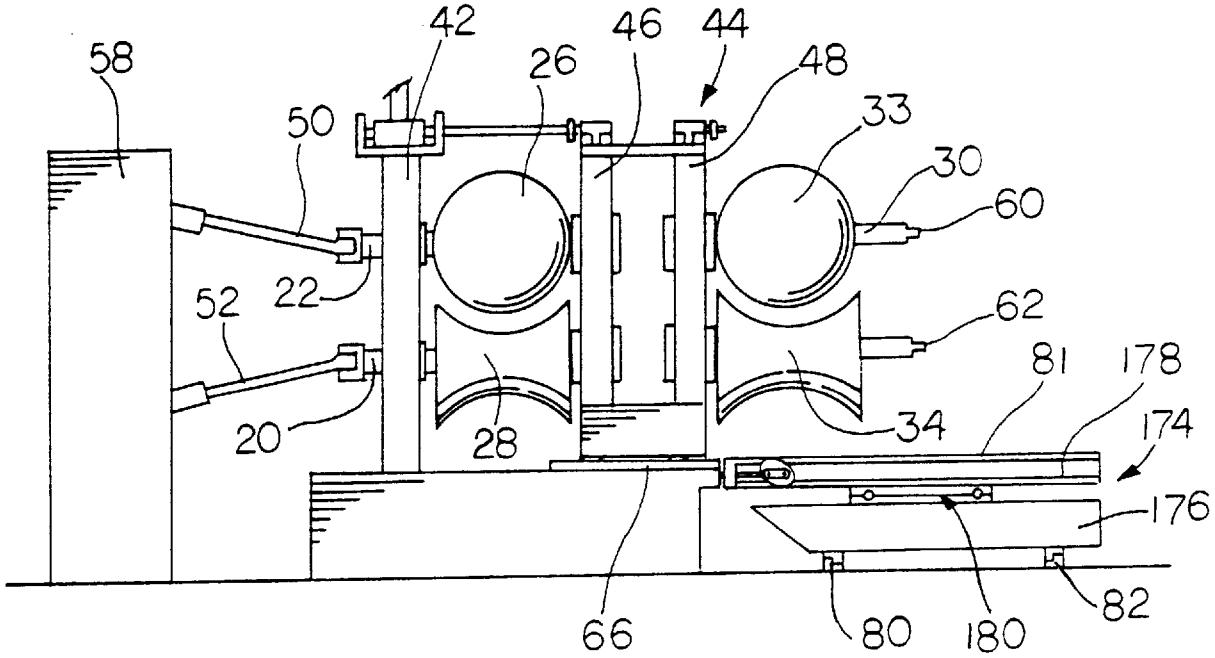
FIG. 7 is a view similar to FIG. 3, but illustrating another embodiment of the invention.
Figure 9:
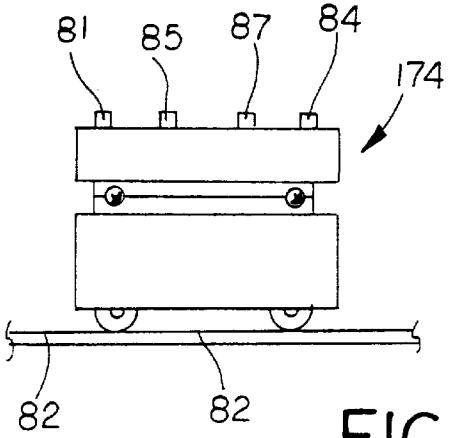
FIG. 9 is a side view of the changing cart illustrated in FIGS. 7 and 8.
Figure 8:
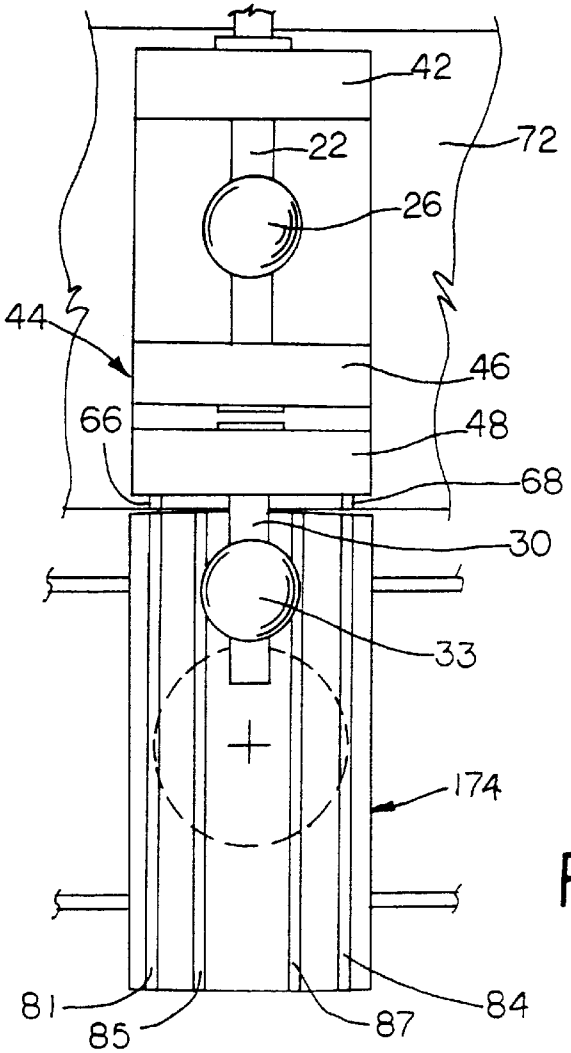
FIG. 8 is a fragmentary top plan view of the device illustrated in FIG. 7.

Referring now to the embodiment of FIGS. 7–9, references the same or substantially the same as those in the preferred embodiment retain the same reference character. In the embodiment of FIGS. 7–9, the cart 74 is replaced by a cart 174 consisting of a base 176 mounted for movement along the rails 80, 82 and a table 178 upon which the rails 81, 84 and 85, 87 are mounted which is mounted for rotation relative to the base 176 on a conventional bearing assembly generally indicated by the numeral 180. The bearing assembly 180 permits rotation of the table 178 relative to the base 176. Accordingly, the turret mechanism 64 is replaced by a fixed plate that slides along rails 66, 78. Accordingly, when retooling is to be effected, bearing housing 44 is moved onto the table 176 by sliding on the rails 66 and onto the rails 81, 84. The table 178 is then rotated about the base 176 via the bearing 180, so that the housing 44 is rotated 180°. Housing 44 is then moved back onto the base 72 by sliding the housing 44 off of the cart 174 and onto the rails 66. The cart 174 can then be moved to the next stand in which retooling can be effected. Accordingly, bearings need not be provided on each of the mill stands, instead only a single bearing is provided on the cart 174.

I claim:

1. A roll forming machine comprising multiple mill stands defining a material pass line through the mill stands, said mill stands each including a drive bearing housing, a rotatable bearing housing, and an active pair of spaced rotatable arbors supported on said bearing housings, said active pair of arbors carrying a first pair of tube shaping rolls cooperating to define said material pass line therebetween, an inactive pair of rotatable arbors connected to said rotatable bearing housing for carrying a second pair of tube shaping rollers, drive means for rotating said active pair of arbors as a strip of metal passes through said rolls along said material pass line, said rotatable bearing housing being supported by a bearing housing support, a cart mounted for movement parallel to said material pass line, said cart and said rotatable bearing housing carrying cooperating sliding supports for slidably supporting said rotatable bearing housing for movement from said bearing housing support to said cart and from the cart to the bearing housing support in a direction transverse to the material pass line, and rotatable means for supporting said rotatable bearing housing for rotation about a substantially vertical axis after the latter has been moved from said bearing housing support to said cart whereby the inactive pair of arbors become the active pair of arbors after the rotatable bearing housing is moved from said cart back onto the bearing housing support after operation of the rotatable means, and means for shifting parallel to said material pass line said cart between said mill stands.

2. Roll forming machine as claimed in claim 1, wherein said sliding supports include transversely extending rails on said bearing housing support and on said cart extending transversely to the material pass line, the transversely extending rails on the cart registering with the transversely extending rails on the bearing housing support when the cart is moved into a position permitting the bearing support to be moved from the bearing housing support to the cart.

3. Roll forming machine as claimed in claim 2, wherein a releasable position lock locks the cart against movement relative to the bearing housing support when the transversely extending rails on the cart are brought into registry with the transversely extending rails on the bearing housing support.

4. Roll forming machine as claimed in claim 3, wherein said releasable lock includes a pin which is installed in registering apertures on the cart and on the bearing housing support.

5. Roll forming machine as claimed in claim 2, wherein cart supporting rails extend parallel to the material pass line, said cart being movable between said mill stands on said cart supporting rails.

6. Roll forming machine as claimed in claim 1, wherein said rotatable means includes a bearing mounted within said rotatable bearing housing for rotatably supporting the latter for rotation about a substantially vertical axis.

7. Method of changing shaping rollers mounted on successive mill stands of a roll forming machine, said mill stands defining a material pass line, comprising the steps of mounting an active pair of arbors carrying a first set of said shaping rollers between a drive bearing housing and a rotatable bearing housing, said rotatable bearing housing being mounted on a bearing housing support, mounting an inactive pair of arbors carrying a second set of said shaping rollers on the rotatable bearing housing, moving a changing cart parallel to the material pass line into a position adjacent a selected mill stand the shaping rolls of which are to be changed, displacing the rotatable bearing support transversely to the material pass line from said bearing housing support onto said cart, rotating said rotatable bearing housing while on said cart about a generally vertical axis, and displacing said rotatable bearing support from said cart back onto said bearing housing support, whereby the inactive arbors become the active arbors.

8. Method of changing shaping rollers as claimed in claim 7, including the step of moving said cart in a direction parallel to the material pass line to a position adjacent another of said mill stands and then changing the arbors of said another mill stands by repeating the foregoing method steps.

9. Method of changing shaping rollers as claimed in claim 7, wherein said bearing housing support and said cart have rails for slidably supporting the rotatable bearing housing, said method including the step of moving the cart to a position in which the rails on the cart register with the rails on the bearing housing support.

10. Method of changing shaping rollers as claimed in claim 9, wherein said method includes the step of locking the cart to the bearing housing support when the rails on the cart register with the rails on the bearing housing support.

11. Method of changing shaping rollers as claimed in claim 7, wherein said method includes the step of moving said cart into a position in which sliding supports on the cart register with corresponding sliding supports on the bearing housing support, and then securing the cart to the bearing housing support while the sliding supports are in registry with one another before sliding the rotatable bearing housing onto the cart.

12. Method of changing shaping rollers as claimed in claim 7, including the step of rotating said rotatable bearing housing about a bearing carried within said housing.

* * * * *